US012442582B2

(12) United States Patent
Ingargiola et al.

(10) Patent No.: US 12,442,582 B2
(45) Date of Patent: Oct. 14, 2025

(54) REFRIGERATION APPLIANCE EQUIPPED WITH A FAN ASSEMBLY AND A METHOD FOR MANUFACTURING SAID APPLIANCE

(71) Applicant: ELECTROLUX APPLIANCES AKTIEBOLAG, Stockholm (SE)

(72) Inventors: Paolo Ingargiola, Porcia (IT); Michele Sedrani, Porcia (IT); Francesco Cristiano, Porcia (IT); Pier Luigi Covre, Porcia (IT)

(73) Assignee: Electrolux Appliances Aktiebolaget, Stockholm (SE)

( * ) Notice: Subject to any disclaimer, the term of this patent is extended or adjusted under 35 U.S.C. 154(b) by 328 days.

(21) Appl. No.: 17/908,932

(22) PCT Filed: Mar. 1, 2021

(86) PCT No.: PCT/EP2021/055002
§ 371 (c)(1),
(2) Date: Sep. 2, 2022

(87) PCT Pub. No.: WO2021/190864
PCT Pub. Date: Sep. 30, 2021

(65) Prior Publication Data

US 2023/0098419 A1 Mar. 30, 2023

(30) Foreign Application Priority Data

Mar. 24, 2020 (EP) ..... 20165291

(51) Int. Cl.
*F25D 17/00* (2006.01)
*F25D 17/04* (2006.01)
*F25D 17/06* (2006.01)

(52) U.S. Cl.
CPC ..... *F25D 17/067* (2013.01); *F25D 17/045* (2013.01); *F25D 17/065* (2013.01); *F25D 2317/067* (2013.01)

(58) Field of Classification Search
CPC .... F25D 17/045; F25D 17/065; F25D 17/067; F25D 2317/067; F25D 11/02; F25D 17/08; F25D 2201/10; F25D 2317/0661
See application file for complete search history.

(56) References Cited

U.S. PATENT DOCUMENTS 5,819,552 A * 10/1998 Lee ..... F25D 17/065 62/407
8,418,485 B2 * 4/2013 Nishita ..... F25D 23/12 62/159

(Continued)

FOREIGN PATENT DOCUMENTS

CN 106958973 7/2017
CN 107388702 12/2019

(Continued)

OTHER PUBLICATIONS

International Search Report and Written Opinion for PCT/EP2021/055002, dated May 25, 2021, 8 pages.

*Primary Examiner* — Filip Zec
(74) *Attorney, Agent, or Firm* — Chrisman Gallo Tochtrop LLC

(57) ABSTRACT

The invention relates to a refrigeration appliance (1) comprising an outer cabinet (2) and an inner liner (22), internal to the outer cabinet (2), defining at least one compartment (10) for receiving food items. A refrigeration system (30) comprises an evaporator (38) arranged inside the compartment (10) to cool down air. A fan assembly (50) is arranged inside the compartment (10) and associated to the evaporator (38) for generating a cooling air stream for the compartment (10). The fan assembly (50) comprises, arranged side by (Continued)

side: a first layer (70) of expanded polystyrene; a fan (72) comprising a rotor (82) with a rotation axis (X) inclined with respect to a vertical direction (V) and a cover plate (76). The fan assembly (50) comprises a fastening device (90) apt to fasten the cover plate (76) to the first layer (70) to keep the fan assembly (50) in the assembled configuration.

14 Claims, 10 Drawing Sheets

(56) References Cited

U.S. PATENT DOCUMENTS

| | | | | |
|---|---|---|---|---|
| 8,820,110 | B2 * | 9/2014 | Schenk | F25C 1/08 62/344 |
| 8,863,537 | B2 * | 10/2014 | Junge | F25D 11/02 62/443 |
| 9,217,600 | B2 * | 12/2015 | Malisi | F25D 17/067 |
| 10,036,585 | B2 * | 7/2018 | McCollough | F25C 5/182 |
| 10,041,738 | B2 * | 8/2018 | Candeo | F25D 17/067 |
| 10,101,077 | B2 * | 10/2018 | Simpson | F25D 17/062 |
| 10,254,037 | B2 * | 4/2019 | Candeo | F25D 17/062 |
| 10,712,079 | B2 * | 7/2020 | Akalan | F25D 23/006 |
| 11,346,591 | B2 * | 5/2022 | Picanço | F25D 17/067 |
| 11,559,147 | B2 * | 1/2023 | Joardar | A47F 3/0443 |
| 2004/0172964 | A1 * | 9/2004 | Brachert | F25D 23/069 62/407 |
| 2009/0205356 | A1 * | 8/2009 | Collins | F25D 17/062 62/515 |
| 2016/0146224 | A1 * | 5/2016 | Mutlu Bozay | F25D 17/067 417/423.15 |
| 2017/0343269 | A1 * | 11/2017 | Kim | F25D 23/068 |
| 2019/0368800 | A1 | 12/2019 | Cheng et al. | |

FOREIGN PATENT DOCUMENTS

| | | |
|---|---|---|
| JP | 2018066346 | 4/2018 |
| KR | 20010011784 | 2/2001 |

* cited by examiner

REFRIGERATION APPLIANCE EQUIPPED WITH A FAN ASSEMBLY AND A METHOD FOR MANUFACTURING SAID APPLIANCE

FIELD OF THE INVENTION

The present invention relates to a refrigeration appliance, more specifically to a refrigeration appliance equipped with a fan assembly for circulating air within a compartment of the refrigeration appliance.

BACKGROUND ART

Refrigeration appliances of known types generally include an inner liner disposed within an outer cabinet. The inner liner typically defines one or more compartments, for example a fresh food compartment and a freezer compartment. Each compartment has an open front closed by a door pivotally mounted to the outer cabinet. Compartments are preferably provided with shelves and/or storage drawers to receive items therein.

A refrigeration system is provided to cool the compartments. The refrigeration system typically includes an evaporator which is preferably mounted inside one of the compartments. The evaporator is advantageously mounted to the rear wall of the compartments itself. A protective plate, or cover plate, is usually disposed over the evaporator and towards the interior of the compartment so that a gap is defined between the rear wall and the same cover. A fan is placed in the gap for creating a cooling air stream for the compartment/s. The air passes over the evaporator which cools the air passing therethrough and then the fan conveys the cooled air, coming from the evaporator, inside the compartment/s. One or more air conveying channels comprising air outlet vents opening realized in the cover (and/or above/below the cover) allows conveyance of the cooled air from the fan outlet into the compartment. Conveyance channels are preferably realized in a layer of plastic foam insulation material disposed adjacent to the side wall of the cover and closed to the fan outlet.

During manufacturing process of the appliance, the evaporator is firstly fixed to the rear wall of the inner liner inside the compartment and then the fan, the plastic foam layer and the cover plate are connected together through fasteners, such as screws, bolts, etc., to keep them in place.

A drawback of this known technique derives from the complexity of the mounting method during manufacturing process of the appliance.

The mounting method does not assure the stability of the evaporator fan and often causes undesirable vibration and noise during operation. In instances where the refrigeration appliance is a domestic refrigerator, the noise and vibration can be annoying to consumers and/or give the consumer the impression that the refrigeration appliance is poorly designed and/or poorly manufactured.

It is an object of the present disclosure to overcome at least some of the problems associated with the prior art.

It is an object of the invention to implement a system apt to simplify manufacturing process of refrigeration appliances compared to known process.

It is another object of the invention to implement a system apt to reduce manufacturing time and/or costs compared to known systems.

It is a further object of the invention to implement a system apt to guarantee a more compact configuration of assembled components compared to known systems.

It is another object of the invention to implement a system apt to reduce noise during operation of the refrigeration appliance.

It is a further object of the invention to implement a system apt to improve reliability of the refrigeration appliances.

DISCLOSURE OF INVENTION

The applicant has found that by providing a refrigeration appliance having a compartment receiving an evaporator of a refrigeration system and by providing a pre-assembled fan assembly which is arranged inside the compartment adjacent the evaporator, it is possible to solve the drawbacks of the known systems.

According to one aspect of the present disclosure there is provided a refrigeration appliance comprising:

- an outer cabinet extending in a vertical direction and comprising a base suitable to lay on the ground, a roof and lateral side walls connecting said base and said roof;
- an inner liner, internal to said outer cabinet, defining at least one compartment for receiving food items;
- a door apt to open and close said at least one compartment;
- a refrigeration system comprising an evaporator to cool down air for said at least one compartment, said evaporator being arranged inside said at least one compartment at a first wall thereof;
- a fan assembly arranged inside said compartment and associated to said evaporator for generating a cooling air stream for said at least one compartment; wherein said fan assembly comprises, arranged side by side:
- a first layer of expanded polystyrene;
- a fan comprising a rotor with a rotation axis inclined with respect to a vertical direction;
- a cover plate;

and wherein said fan assembly comprises a fastening device apt to fasten said cover plate to said first layer to keep said fan assembly in the assembled configuration.

For arranged side by side it is meant arranged one laterally of the other and preferably in a lateral order perpendicular to the vertical direction; in other words, each component is at least partially stacked/in contact to the laterally adjacent component.

Preferably, in its installed position, lateral side walls of the outer cabinet are aligned to the vertical direction.

Preferably, the fastening device is apt to fasten the cover plate to the first layer to keep staked, preferably in the following order, the first layer and the fan in their assembled position.

In a preferred embodiment, the fan assembly further comprises a second layer of expanded polystyrene arranged between the fan and the cover plate.

Preferably, the fastening device is apt to fasten the cover plate to the first layer to keep staked, preferably in the following order, the first layer, the fan and the second layer in their assembled position.

The fan is therefore firmly sandwiched between the first layer and the second layer of expanded polystyrene EPS.

Advantageously, the fan assembly with associated fastening device guarantees a compact configuration that avoids/reduces vibrations between them, in particular during activation of the fan.

This results in a reduction of noise during operation of the refrigerator and/or also an improved reliability of the refrigerator.

In a preferred embodiment of the invention, the rotation axis of the rotor is inclined with respect to the lateral side walls of the outer cabinet when the appliance is in its installed position.

Advantageously, inclination of the rotor with respect the vertical direction guarantees a good fluid dynamics efficiency for the fan. Furthermore, inclination of the rotor minimized the space occupied by the assembly fan so that the volume of the compartment is not negatively affected.

According to a preferred embodiment of the invention, the first wall of the compartment is the rear wall of the compartment.

Preferably, the first layer comprises one or more air conveying channels and the cover plate comprises one or more air opening communicating with the one or more air conveying channels when the fan assembly is assembled.

Preferably, in case a second layer is present, also the second layer may comprise one or more air conveying channels.

In a preferred embodiment of the invention, the fastening device comprises snap fit elements.

According to a preferred embodiment of the invention, the fastening device comprises elastic tongues protruding from the cover plate interacting with recesses in the first layer.

Advantageously, the fastening device and the cover plate realize a single body so that there is no need of separated fastening means, thus reducing complexity of the fan assembly and simplifying assembling process steps.

Preferably, the first layer comprises a seat to at least partially receive the fan.

In a preferred embodiment of the invention, the fan assembly comprises a mounting element apt to mount the fan to the first layer.

According to a preferred embodiment of the invention, the mounting element comprises one or more pins apt to be inserted in respective one or more through holes of the first layer and comprising blocking elements connected at the tip of the one or more pins and abutting a surface of the first layer, allowing the constraint of the mounting element to the first layer.

Preferably, vibration dampening elements are interposed between the fan and the mounting element. Advantageously, vibration dampening elements absorb vibrations created by the fan rotation.

In a preferred embodiment of the invention, the fan comprises a frame apt to support the rotor.

According to a preferred embodiment of the invention, the frame is connected to the mounting element through a carrier structure.

Preferably, vibration dampening elements are interposed between the frame of the fan and the mounting element, more preferably interposed between the frame of the fan and carried structure.

In a preferred embodiment of the invention, the fan assembly further comprises a fan mouth where air flows from the evaporator to the fan.

According to a preferred embodiment of the invention, the fan mouth is placed between the first layer and the fan.

Preferably, the fan mouth and the mounting element are integrally made.

Advantageously manufacturing time and/cost are reduced.

In a preferred embodiment of the invention, connecting means are apt to connect the fan assembly to the first wall of the compartment.

According to a preferred embodiment of the invention, the fan is a centrifugal fan, preferably a radial fan.

In a further aspect thereof, the present invention relates a method for manufacturing a refrigeration appliance comprising the steps of:

providing an outer cabinet;

assembling an inner liner to define a compartment for receiving food items;

assembling a refrigeration system comprising an evaporator wherein said evaporator is arranged inside said compartment at a first wall thereof;

assembling a fan assembly adjacent to said evaporator, wherein said fan assembly is a pre-assembled assembly obtained by the steps of fastening together, side by side, the following elements:

a first layer of expanded polystyrene;

a fan comprising and a rotor with a rotation axis inclined with respect to a vertical direction;

a cover plate.

In a preferred embodiment of the invention, said fastening steps comprises:

mounting the fan to the first layer;

assembling the cover plate to the first layer.

In a further preferred embodiment, said fan assembly is a pre-assembled assembly obtained by the steps of fastening together, side by side, the following elements:

a first layer of expanded polystyrene;

a fan comprising and a rotor with a rotation axis inclined with respect to a vertical direction;

a second layer of expanded polystyrene;

a cover plate.

In such preferred embodiment, said fastening steps comprises:

mounting the fan to the first layer;

assembling the first layer and the second layer therebetween;

assembling the cover plate to the first layer.

BRIEF DESCRIPTION OF THE DRAWINGS

Further characteristics and advantages of the present invention will be highlighted in greater detail in the following detailed description of a preferred embodiment of the invention, provided with reference to the enclosed drawings.

In said drawings.

DETAILED DESCRIPTION OF A PREFERRED EMBODIMENT OF THE INVENTION

Figure 2:
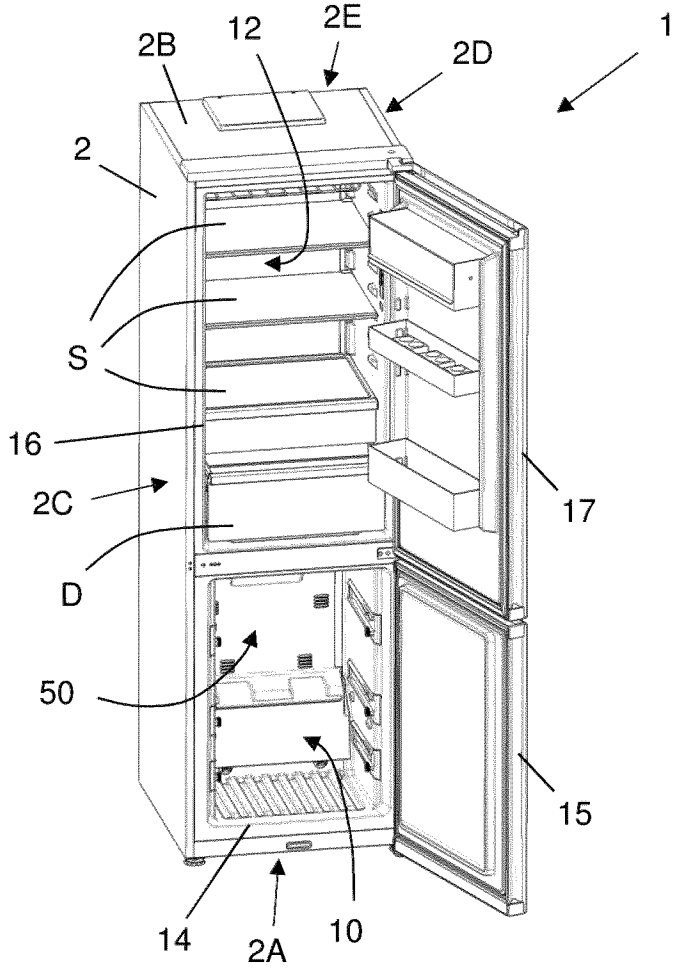
FIG. 2 shows the appliance of FIG. 1 with some elements removed therefrom.
Figure 1:
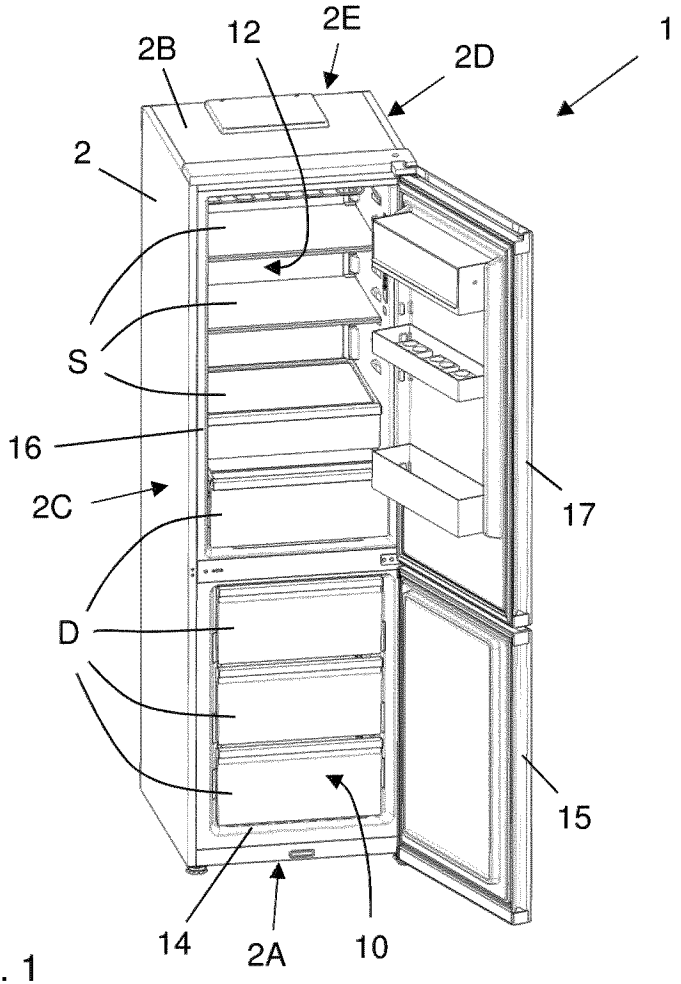
FIG. 1 shows an isometric view of a refrigeration appliance according to a preferred embodiment of the present invention.

Referring to FIGS. 1 and 2 a refrigeration appliance in the form of a domestic refrigerator is shown, indicated generally as 1. Although the detailed description that follows concerns a domestic stand-alone refrigerator 1, the refrigeration appliance can be embodied by refrigeration appliances other than a domestic refrigerator.

Furthermore, the embodiment described in detail below refers to a bottom mount refrigerator, i.e. of the type including a freezer compartment disposed vertically below a fresh food compartment. However, the refrigerator according to the invention can have any desired configuration, for example a top mount refrigerator wherein the freezer compartment is disposed vertically above the fresh food compartment or a refrigerator comprising only a fresh food compartment or only a freezer compartment.

Furthermore, while the present application is described with reference to a stand-alone refrigerator it has to be noted that also a built-in solution may be contemplated.

The refrigeration appliance 1 illustrated in the figures, hereinafter indicated as refrigerator 1, comprises an outer cabinet 2 and an inner liner 22, internally received in the outer cabinet 2. The outer cabinet 2 and the inner liner 22 are separated by a spacing filled with thermal insulation 13, preferably a foam insulation.

The outer cabinet 2 preferably extends in a vertical direction V and preferably comprises a base 2A suitable to lay on the ground, a roof 2B and lateral side walls 2C, 2D, 2E connecting the base 2A and the roof 2B, preferably two lateral side walls 2C, 2D and a rear side wall 2E.

In its installed position, lateral side walls 2C, 2D and the rear side wall 2E are preferably aligned to the vertical direction V.

Figure 3:
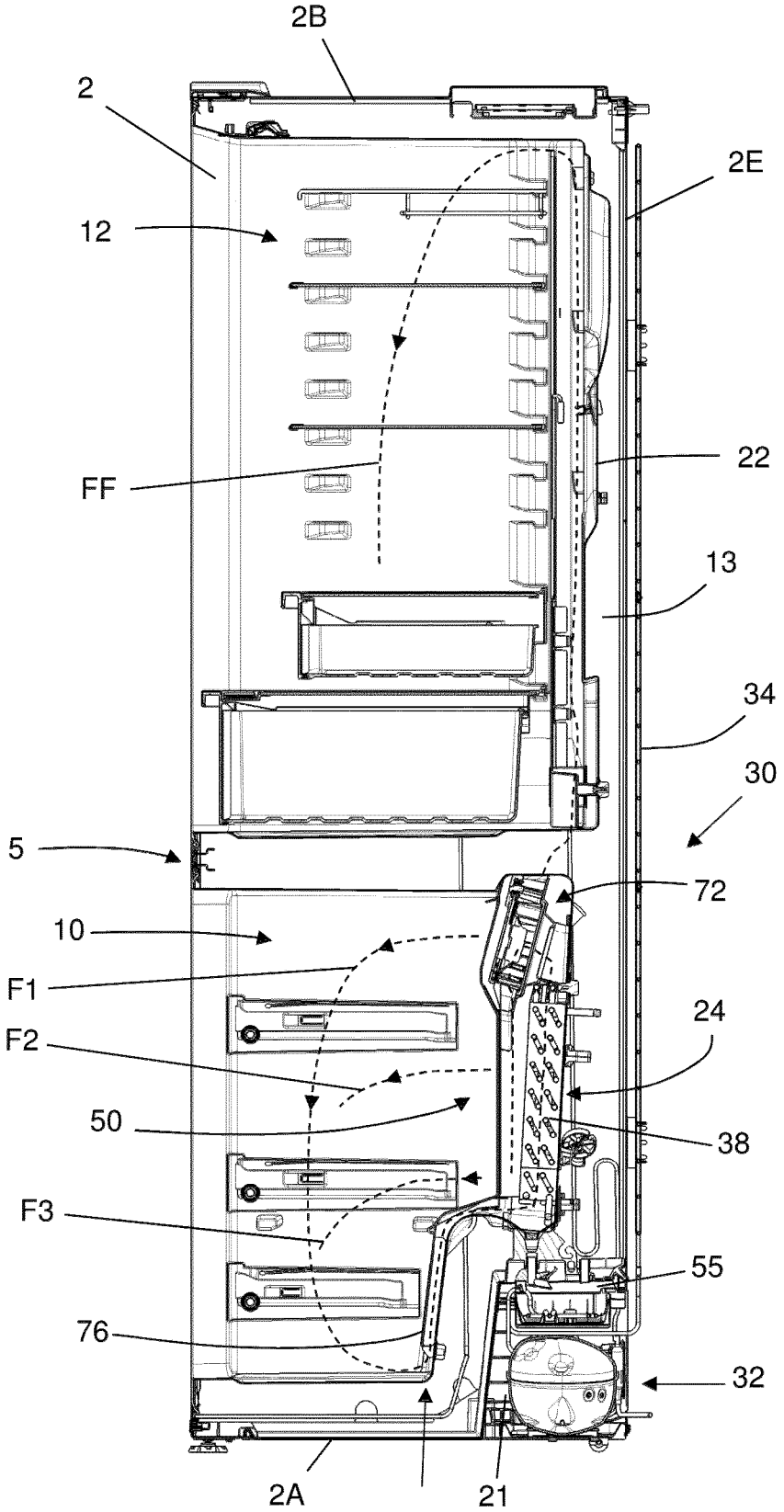
FIG. 3 shows a vertical plan sectional view of the appliance of FIG. 2.

The refrigerator 1 according to the embodiment shown in the figures preferably represents a bottom mount type refrigerator. At this purpose, a divider portion 5 (FIG. 3) is provided which divides inner liner 22 into a lower space that is used as a freezer compartment 10, and an upper space that is used as a fresh food compartment 12.

The freezer compartment 10 substantially preferably has the form of a cuboid defining a rectangularly shaped front opening 14. A door 15 is preferably pivotally mounted to the outer cabinet 2 and is movable between an open position and a closed position to cover the front opening 14.

The freezer compartment 10 preferably shows a rear wall 24 which is defined by a portion of the inner liner 22, more preferably a vertical rear wall 24.

Analogously, the fresh compartment 12 substantially and preferably has the form of a cuboid defining a rectangularly shaped front opening 16. A door 17 is preferably pivotally mounted to the outer cabinet 2 and is movable between an open position and a closed position to cover the front opening 16.

In an alternative embodiment, a single door can be provided to open and close both the front openings 14, 16 of the freezer and the fresh compartments 10, 12.

The compartments 10, 12 preferably comprise shelves S and/or drawers D for receiving food items.

A refrigeration system 30 is preferably provided to cool the compartments 10, 12.

According to the present invention, the refrigeration system 30 is apt to cool down air which is circulated inside at least one compartment of refrigerator 1, preferably to cool down air which is circulated inside both compartments 10, 12.

In the preferred embodiment of the invention, the refrigeration system 30 preferably comprises a closed recirculating system filled with a suitable refrigerant, for example R12 or R134a. The refrigeration system preferably comprises an electric motor-driven compressor 32, a condenser heat exchanger 34, a pressure device such as a capillary tube or a thermostatic valve (not shown) and an evaporator 38.

A collecting tray 55 is preferably arranged below the evaporator 38 to collect water formed by condensation on the evaporator 38.

The evaporator 38 is preferably mounted inside the freezer compartment 10, whereas the compressor 32 is mounted external to the freezer compartment 10 and preferably arranged in a working chamber 21 at the bottom of the refrigerator 1.

The condenser heat exchanger can be a condenser tubing 34 that preferably has a serpentine configuration and is preferably externally secured to the rear side wall 2E of the outer cabinet 2 so as to form what is commonly known as a "hot wall".

Further features of the refrigeration system 30 are not described in detail in the present application since are well known in the art.

The evaporator 38 is more preferably mounted to the rear wall 24 of the freezer compartment 10 towards the interior of the freezer compartment 10.

Figure 5:
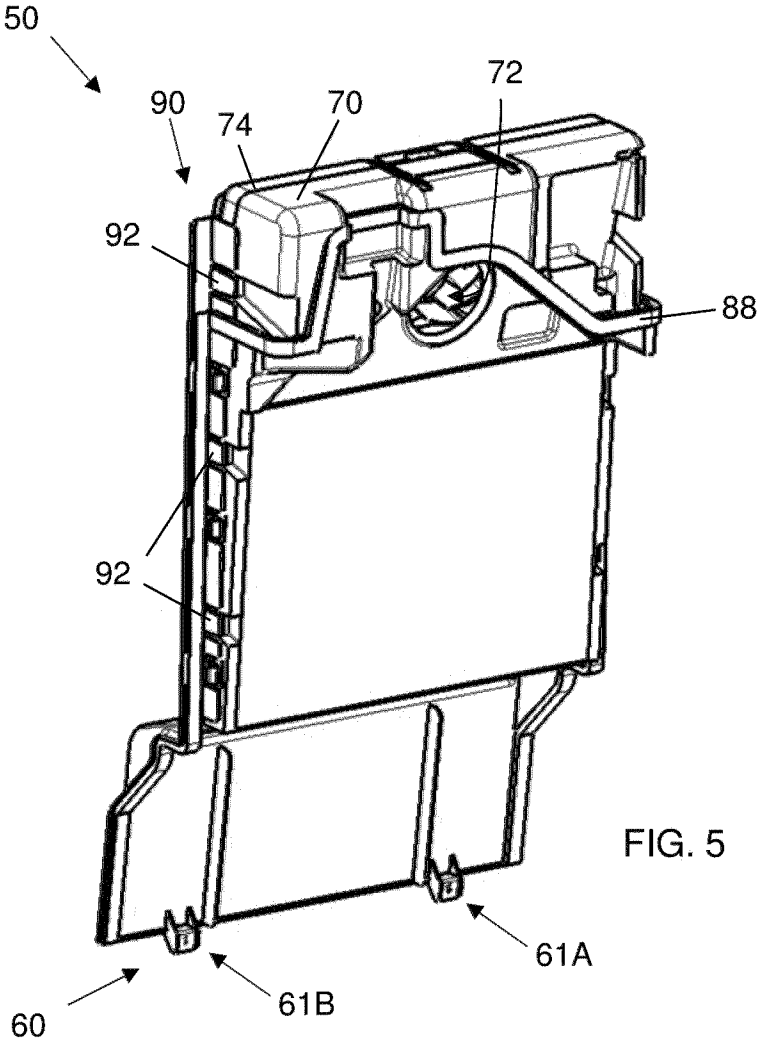
FIG. 5 shows the fan assembly of FIG. 4 from another point of view.
Figure 4:
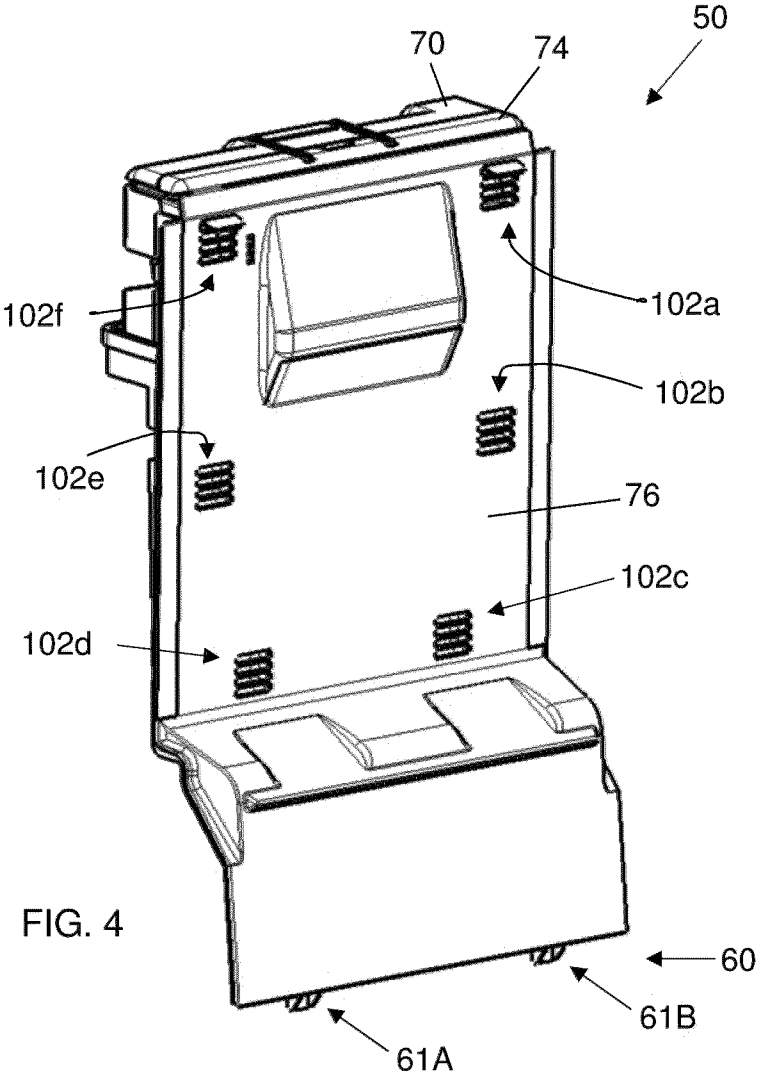
FIG. 4 shows an isometric view of a fan assembly according to a preferred embodiment of the present invention.
Figure 6:
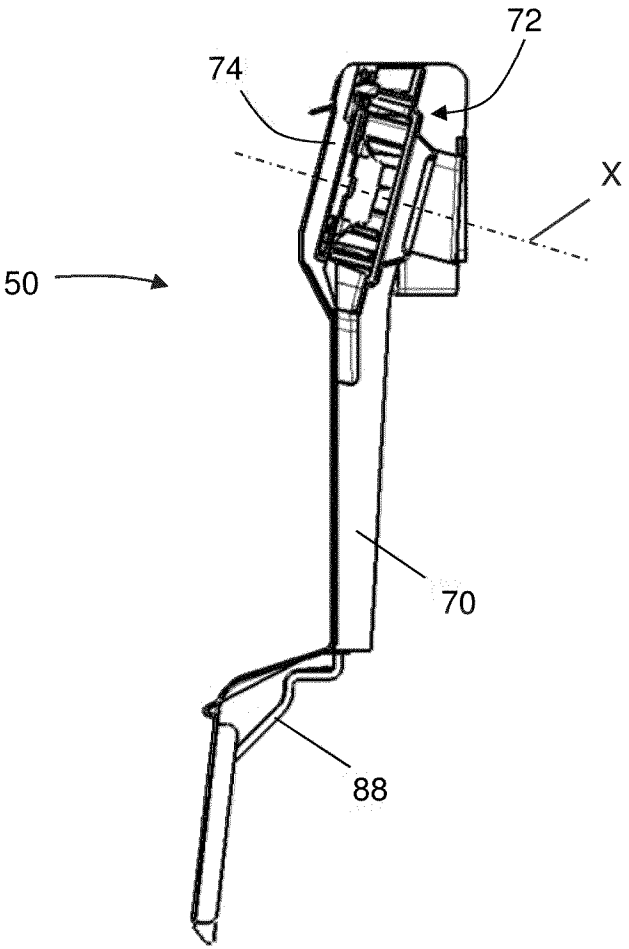
FIG. 6 shows a vertical plan sectional view of the fan assembly of FIG. 5.

According to the invention, a pre-assembled fan assembly 50 is arranged closed to the evaporator 38. The fan assembly 50 is shown isolated from the rest in FIGS. 4 to 6.

The fan assembly 50 is advantageously pre-assembled during manufacturing of the refrigerator 1 and then it is mounted inside the freezer compartment 10 over the evaporator 38.

The fan assembly 50 is preferably connected to the rear wall 24 of the freezer compartment 10 through connecting means 60.

In the preferred embodiment illustrated in the figures, the connecting means 60 preferably comprise two lower protruding tabs 61A, 61B with holes for receiving fixing screws (not shown). The fan assembly 50 is assembled to the freezer compartment 10 by inserting its upper part in position inside the freezer compartment 10, rotating its lower part to bring the fan assembly 50 in its final position and finally fixing the fan assembly 50 to the inner liner 22 with screws inserted in the tabs 61A, 61B.

In different preferred embodiments, the connecting means may comprise other type of fasteners, such as mechanical (e.g. rivets, nuts and bolts, etc.), chemical (e.g. adhesive, epoxy, etc.), or other type of fasteners.

The function of the fan assembly 50 is to generate the cooling air stream that is conveyed and recirculated inside the freezer compartment 10 and, in the preferred embodiment here illustrated, also inside the fresh food compartment 12. The fan assembly 50 is preferably configured to draw air from the evaporator 38 and to expel it into the freezer compartment 10 and into the fresh food compartment 12.

According to an aspect of the invention, the fan assembly 50 preferably comprises a first layer 70 of expanded polystyrene, a fan 72, a second layer 74 of expanded polystyrene and a cover plate 76.

The first layer 70, the fan 72, the second layer 74 and the cover plate 76 are preferably arranged side by side, i.e. arranged one laterally of the other and preferably in a lateral order perpendicular to the vertical direction V. In other words, each component 70, 72, 74, 76 is at least partially stacked/in contact to the laterally adjacent component.

Preferably, expanded polystyrene used for the layers 70, 74, i.e. EPS, is a lightweight, rigid plastic foam insulation material made of solid polystyrene particles.

The use of EPS enhances thermal isolation of the fan assembly 50, being EPS a high-quality thermal insulator material.

In addition, the use of EPS enhances acoustic isolation of the fan assembly 50, in particular of noise caused by rotation of the fan 72 and of the air expelled from it.

Furthermore, using of EPS simplifies the fan assembly 50 construction as EPS is an easily handled material. Still advantageously, EPS is a cheap material.

Therefore, manufacturing time and/or costs are reduced compared to known systems.

In a further preferred embodiment of the invention, not shown, the second layer of expanded polystyrene may be omitted.

The fan 72 preferably comprises a rotor 82 with a rotation axis X. The rotor 82 is preferably mounted on a supporting frame 80.

Figure 11:
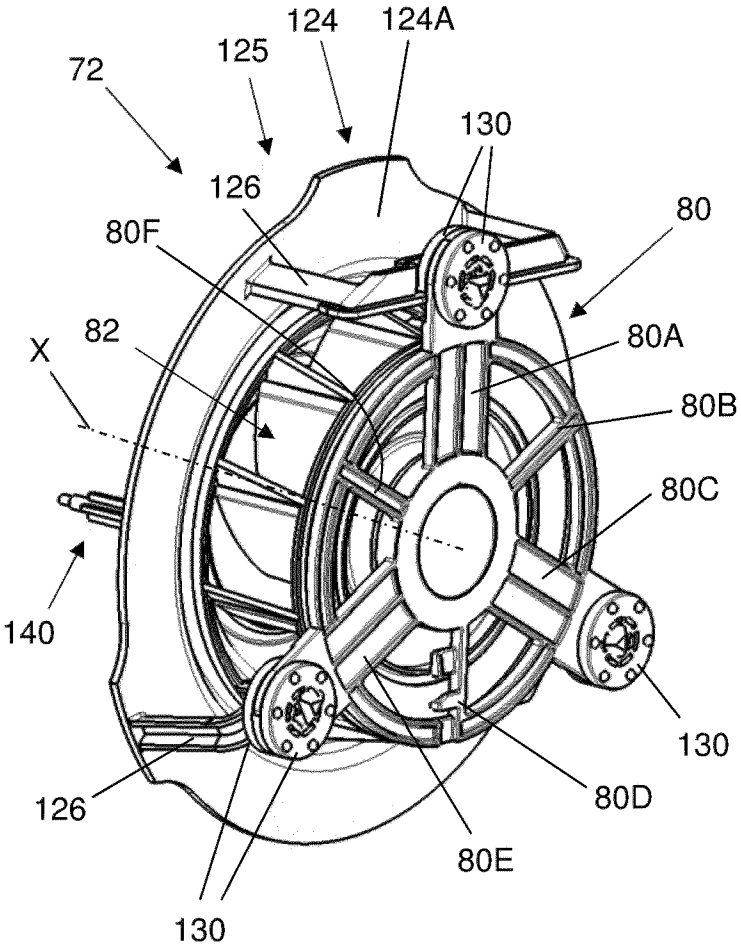
FIG. 11 shows some elements of the fan assembly of FIG. 10 isolated from the rest.

The supporting frame 80 preferably has a spider shaped structure with arms 80A-80F supporting the rotor 52, as visible in FIG. 11.

The fan 72 preferably comprises a centrifugal fan, preferably a radial fan. The air flows from a suction side 72A of the fan 72 facing the evaporator 38, and the air is then displaced radially, changing its direction (typically by) 90°. The rotor 82 preferably consists of a rotating arrangement of vanes or blades, rotating around said axis X, which act on the air.

Preferably, a fan mouth 122 is arranged at the suction side 72A of the fan 72 to convey the air from the evaporator 38 to the rotor 82. The fan mouth 122 preferably faces the evaporator 38 and is preferably placed between the first layer 70 and the fan 72.

In different preferred embodiments, the fan mouth may be omitted.

Figure 3A:
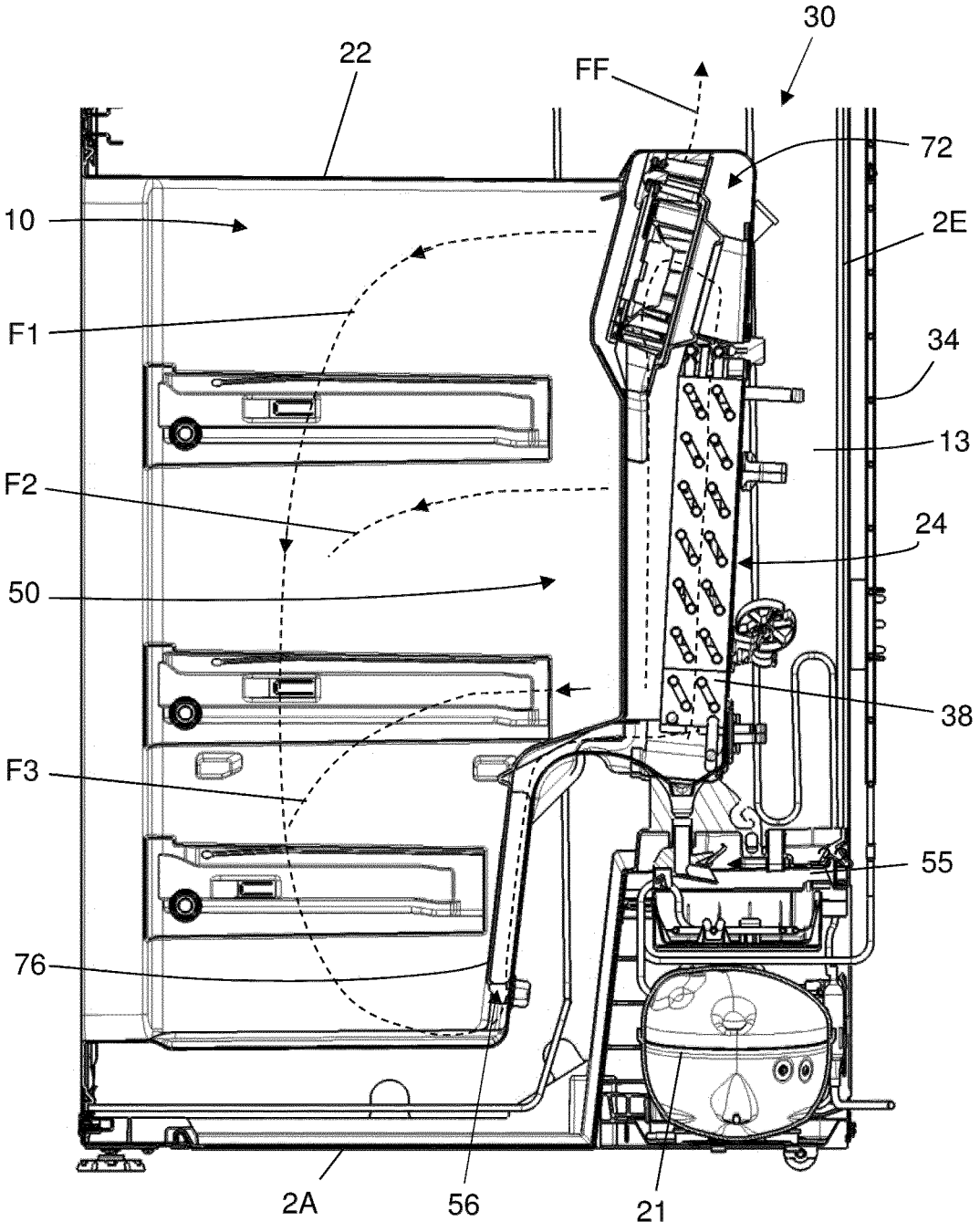
FIG. 3A shows an enlarged view of a particular of FIG. 3.
Figure 3B:
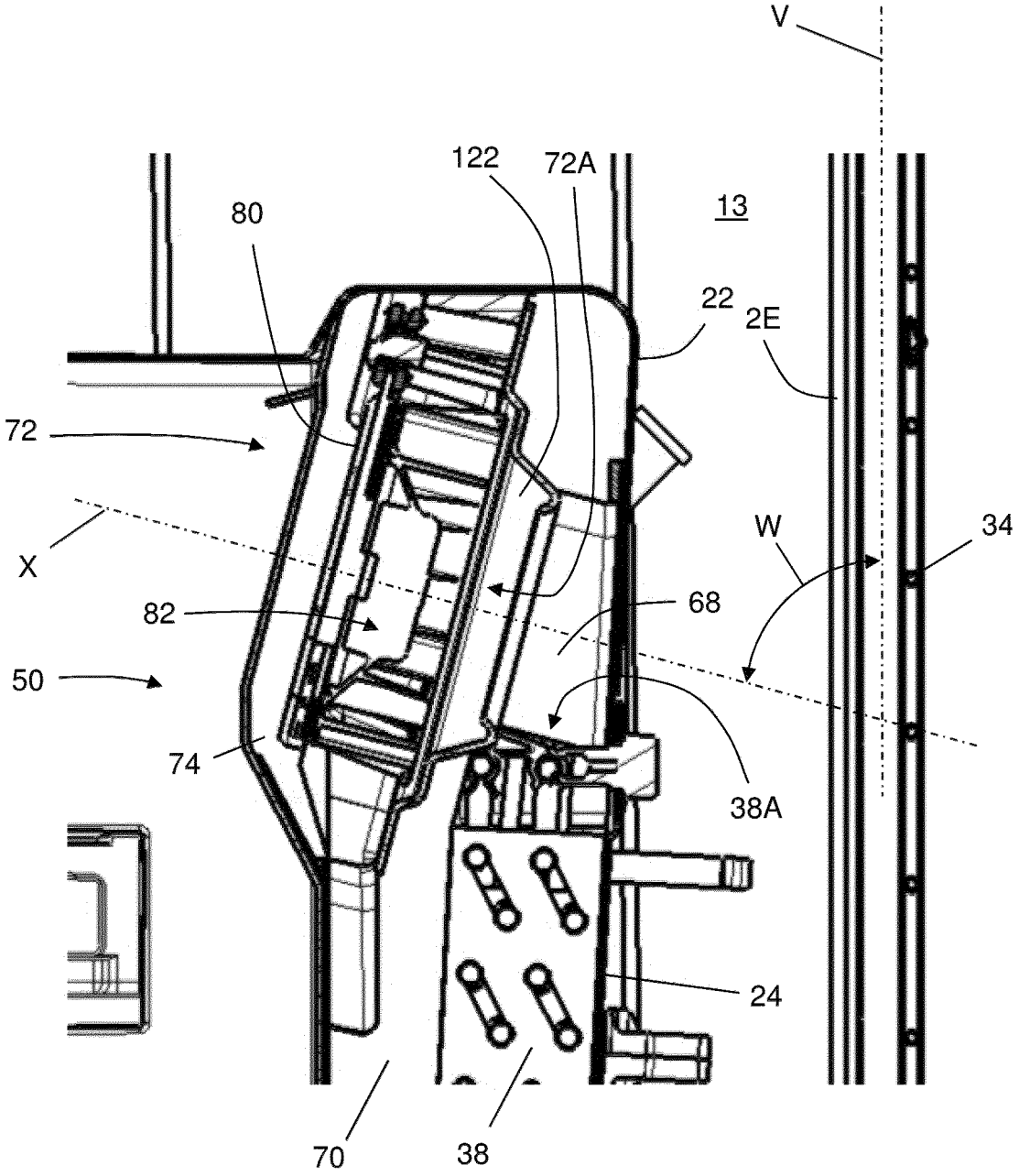
FIG. 3B shows an enlarged view of a particular of FIG. 3A.

A suction chamber 68 is created between the fan 72, preferably the fan mouth 122, and the outlet side 38A of the evaporator 38, as shown in FIG. 3B. The fan 72 draws air from the evaporator 38 through the suction chamber 68 and expels it outside the fan assembly 50, towards the freezer compartment 10 and the fresh food compartment 12, as better described later.

The air preferably flows in the compartments 10, 12 to define closed loop circuits and the fan 72 is switched on/off according to operational condition, for example the temperature level inside the compartments 10, 12 and/or opening of the doors, etc.

According to an aspect of the invention, the rotating axis X of the rotor 82 is inclined with respect to a vertical direction V.

Preferably, the rotating axis X is inclined with respect to the rear side wall 2E of the outer cabinet 2.

The rotating axis X is preferably inclined with respect to the vertical direction V of an angle W comprised between 10° and 80°, more preferably inclined of an angle W equal to 60°.

Advantageously, by inclining the rotor 82 with respect the vertical direction V the suction chamber 68 is shaped to guarantee a good fluid dynamics efficiency and at the same time the space occupied by the fan 72 is minimized so that the volume of the freezer compartment 10 is not negatively affected.

According to an aspect of the invention, the fan assembly 50 comprises a fastening device 90 apt to fasten the cover plate 76 to the first layer 70 to keep elements of the fan assembly 50 in the assembled configuration.

Preferably, the fastening device 90 is apt to fasten the cover plate 76 to the first layer 70 to keep staked, preferably in the following order, the first layer 70, the fan 72 and the second layer 74 in their assembled position.

The fastening device 90 keeps the elements of the fan assembly 50 firmly together. In particular, preferably, the fan 72 is firmly sandwiched between the layers 70, 74 of expanded polystyrene EPS.

In case the second layer of expanded polystyrene is omitted, according to an alternative preferred embodiment of the invention, the fastening device is apt to fasten the cover plate to the first layer to keep staked, preferably in the following order, the first layer and the fan in their assembled position.

Figure 7:
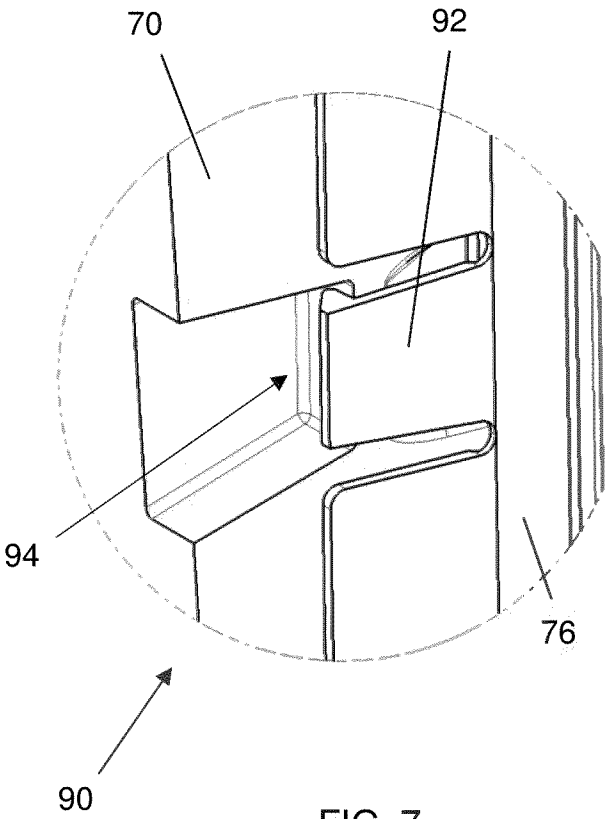
FIG. 7 shows an enlarged view of a particular of FIG. 5.

Preferably, the fastening device 90 comprises snap fit elements. In the preferred embodiment illustrated in the figures, the fastening device 90 comprises elastic tongues 92 protruding from the cover plate 76 which interact with respective recesses 94 in the first layer 70, as better illustrated in FIG. 7. Tongues 92 are preferably made in one piece with the cover plate 76 to realize a single body.

Advantageously, the fan assembly 50 with associated fastening device 90 guarantees a compact configuration that avoids/reduces vibrations between them, in particular during activation of the fan.

This results in a reduction of noise during operation of the refrigerator 1 and/or also an improved reliability of the refrigerator.

Furthermore, advantageously, the fastening device and the cover plate realize a single body so that there is no need of separated fastening means, thus reducing complexity of the fan assembly and simplifying assembling process steps.

In a preferred embodiment of the invention, the first layer 70 comprises one or more air conveying channels 100*a*-100*g* for conveying cooled air expelled from the fan 72 towards the compartments 10, 12.

Figure 8:
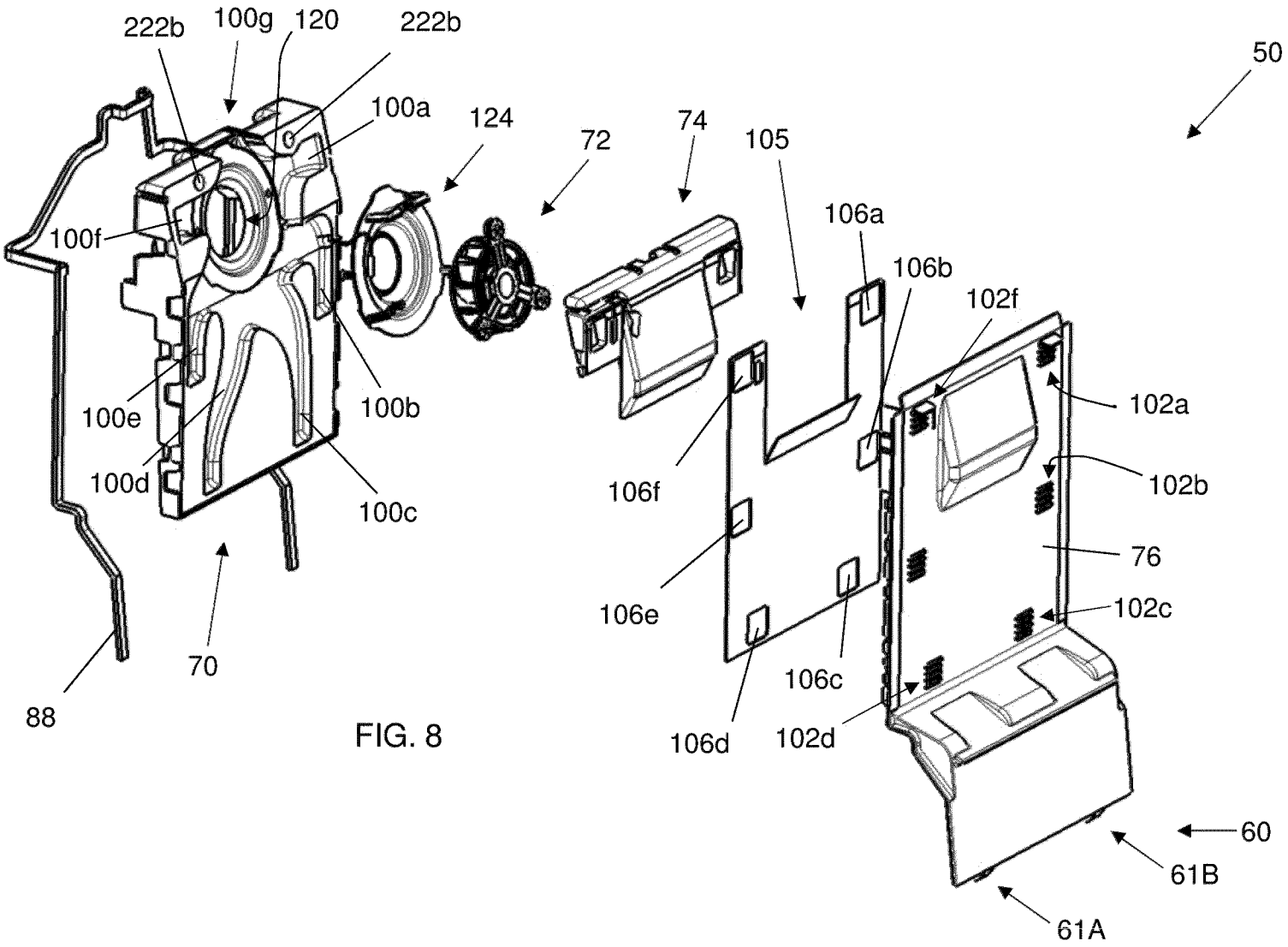
FIG. 8 shows an exploded view of the fan assembly of FIG. 4.
Figure 9:
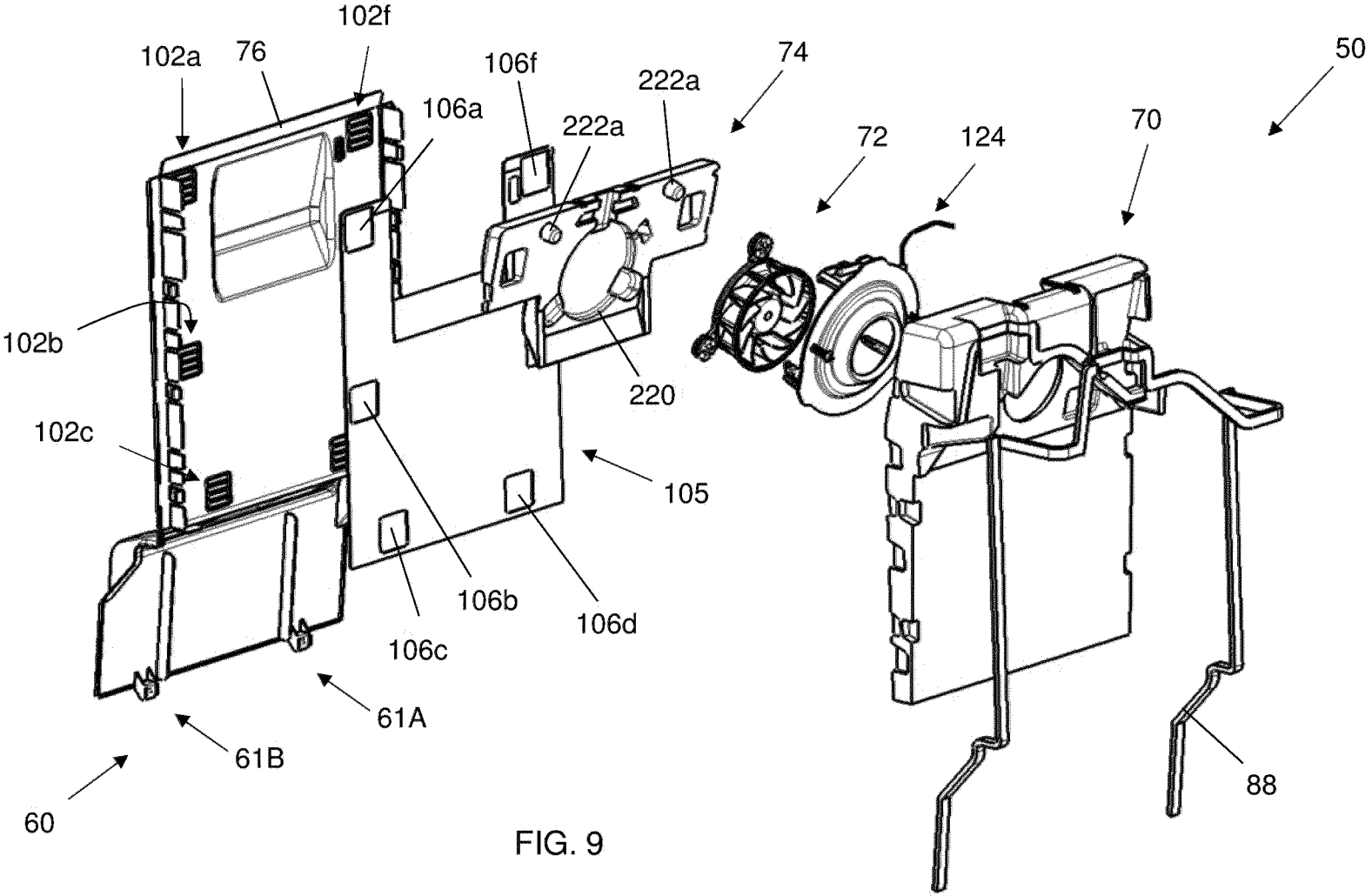
FIG. 9 shows the exploded view of FIG. 8 from another point of view.
Figure 10:
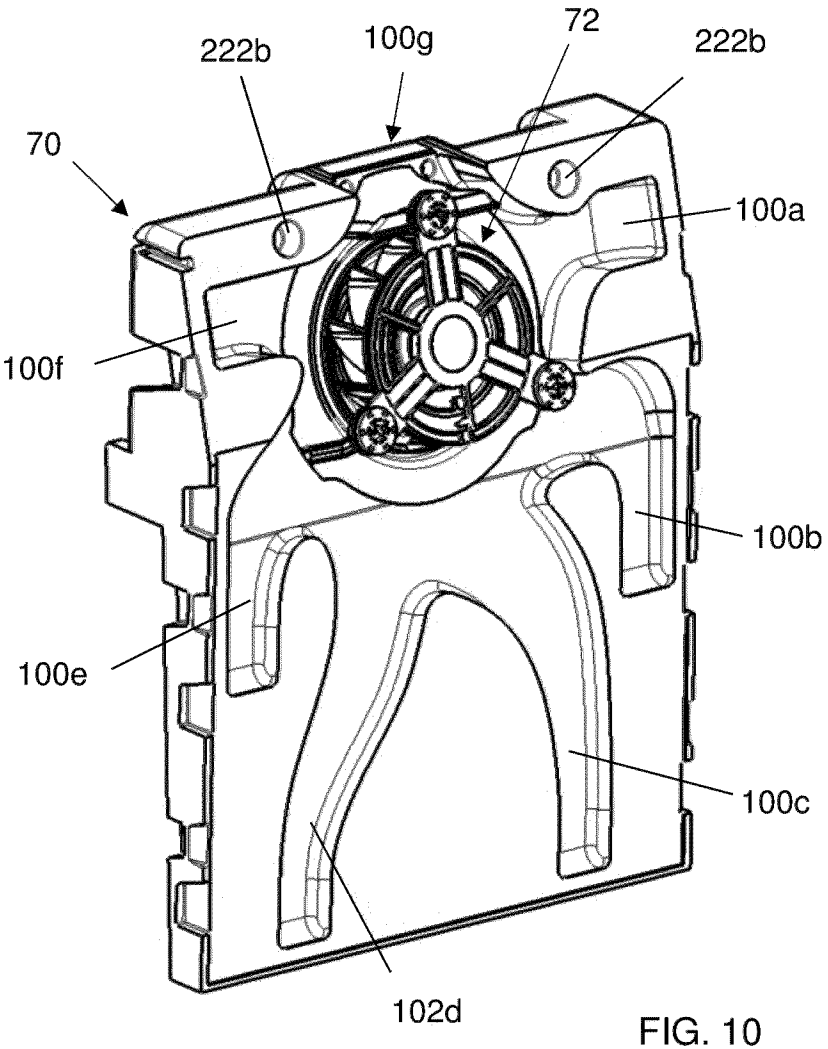
FIG. 10 shows the fan assembly of FIG. 4 with an element removed therefrom.

Conveying channels 100*a*-100*g*, as illustrated in FIGS. 8 and 10, are opened in the direction of the cover plate 76. In the assembled configuration, then, the cover plate 76 opportunely closes the conveying channels 100*a*-100*g* allowing the air conveyance. The first layer 70 with open channels 100*a*-100*g* are easily obtained through an injection mould process with EPS.

Nevertheless, in a further preferred embodiment (not shown) air conveying channels may be realized as closed air conveying channels directly on the first layer.

According to the preferred embodiment illustrated in the figures, there are six air conveying channels 100*a*-100*f* that are radially arranged around the fan 72 for the air to the freezer compartment 10 and an upper air conveying channel 100*g* for the air to the fresh food compartment 12.

The cover plate 76 preferably comprises one or more air opening 102*a*-102*f* communicating with the air conveying channels 100*a*-100*f* of the first layer 70. Cooled air advantageously enters the freezer compartment 10 through said air openings 102*a*-102*f*, which preferably are grated openings.

It is preferably contemplated that the cover plate 76 is made from plastic to provide an aesthetically pleasing appearance to a user.

Preferably, an intermediate sheet 105 is interposed between the first layer 70 and the cover plate 76. The intermediate sheet 105 preferably comprises holes 106*a*-106*f* aligned with the air openings 102*a*-102*f* of the cover plate 76. The intermediate sheet 105 enhances the closure of the conveying channels 100*a*-100*g* of the first layer 70. The intermediate sheet 105 improves the sealing effect for the conveying channels 100*a*-100*g*, in particular in case the cover plate 76 is not perfectly planar.

In a further preferred embodiment, the intermediate sheet may be omitted.

Preferably, the first layer 70 comprises a seat 120 apt to at least partially receive the fan 72.

A mounting element 124 is preferably used to mount the fan 72 to the first layer 70, preferably to the seat 120. More preferably, the mounting element 124 is preferably used to mount the frame 80 of the fan 72 to the first layer 70.

In the preferred embodiment illustrated in the figures, the mounting element 124 is integrally made with the fan mouth 122. Manufacturing time and/cost are advantageously reduced.

In different preferred embodiments, nevertheless, the mounting element and fan mouth can be two independent elements.

The mounting element 124 is arranged in the seat 120 of the first layer 70 and connected thereto. In the preferred embodiment illustrated in the figures the mounting element 124 preferably comprises an annular surface 124A that preferably lays in a plane perpendicular to the axis X of the rotor 82.

The mounting element 124 preferably comprises one more pins 140 apt to be inserted in respective one or more through holes 142 of the first layer 70. The pins 140 preferably protrude from the annular surface 124A of the mounting element 124.

Figure 13:
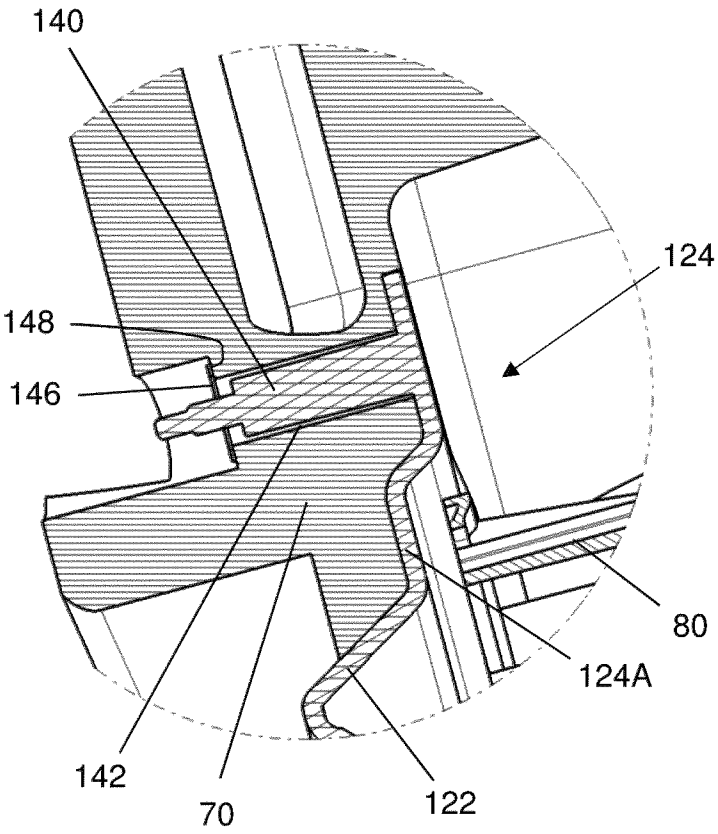
FIG. 13 shows a sectional view of a particular of FIG. 10.
Figure 12:
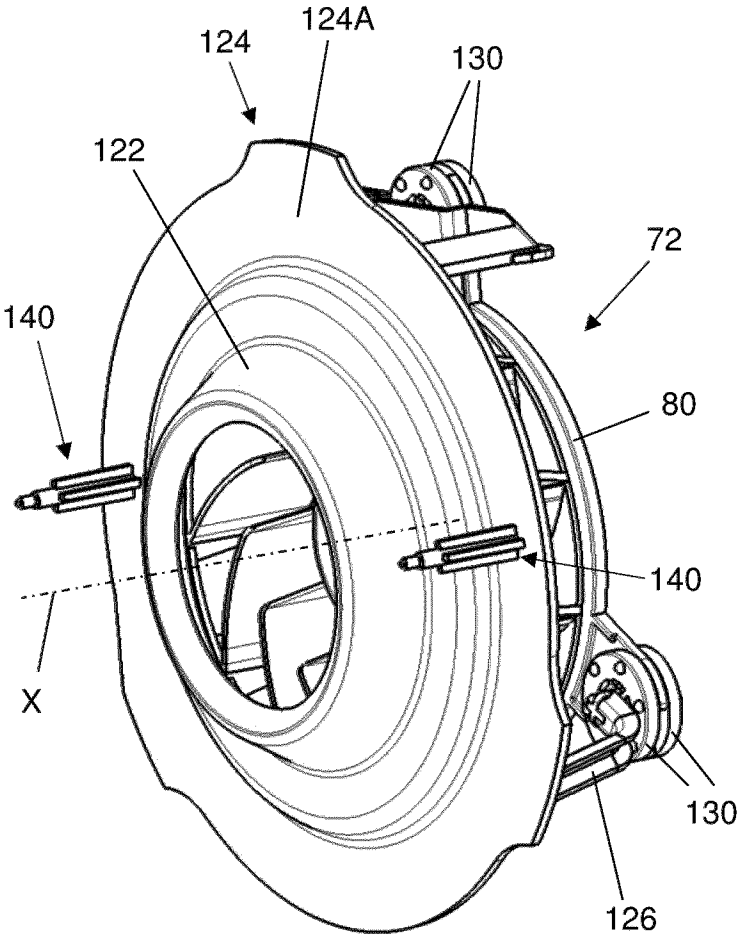
FIG. 12 shows the elements of FIG. 11 from another point of view.

The pins 140 are axially blocked to the first layer 70 with blocking elements 146, for example internal tooth lock washers, connected at the tip of the pins 140 and abutting a surface 148 of the first layer 70, as better visible in FIG. 13. The pins 140, allow the constraint of the mounting element 124 to the first layer 70.

More preferably, the frame 80 of the fan 72 is connected to the mounting element 124 through a carrier structure 125 preferably comprising ribs 126 protruding from the annular surface 124A of the mounting element 124.

In the preferred embodiment illustrated, the ribs 126 define connecting points for the frame 80 of the fan 72, preferably three connecting points (FIG. 11).

In an aspect of the invention, vibration dampening elements 130 are interposed between the fan 72 and the mounting element 124. Preferably, the vibration dampening elements 130 are interposed between the frame 80 of the fan 72 and the mounting element 124. More preferably the vibration dampening elements 130 are interposed between the frame 80 of the fan 72 and the carrier structure 125 of the mounting element 124.

Vibration dampening elements 130 preferably comprise rubber washers interposed between three arms 80A, 80C, 80E of the supporting frame 80 and corresponding ribs 126 of the mounting structure 125.

Vibration dampening elements 130 advantageously absorb vibrations created by the fan rotation.

In a preferred embodiment of the invention, the second layer 74 comprises a seat/opening 220 apt to at least partially receive the fan 72.

The second layer 74, then, preferably comprises protruding pins 222*a* apt to be received in respective holes 222*b* of the first layer 70 when the fan assembly 50 is assembled.

In the assembled configuration, the second layer 74 of EPS enhances acoustic isolation of the noise caused by rotation of the fan 72 towards the internal volume of the freezer compartment 10.

As said above, the air preferably flows in the compartments 10, 12 to define closed loop circuits. Advantageously, the fan assembly 50 create an air flow paths inside the fresh food compartment 12 and air flow paths in the freezer compartment 10, schematically indicated with FF, F1, F2, F3 in FIGS. 3 and 3A.

In particular, air flow path FF is generated by the fan assembly 50 and conveyed to the fresh food compartment 12 through the upper air conveying channel 100*g* of the first layer 70.

Air flow paths F1, F2, F3 are generated by the fan assembly 50 and conveyed to the freezer compartment 10 through the six air conveying channels 100*a*-100*f* of the first layer 70 and air openings 102*a*-102*f* of the cover plate 76.

From the inside of the freezer compartment 10, then, the air flows back to the evaporator 38 through a gap 56 preferably defined between the lower part of the cover plate 76 and the lower part of the rear wall 24 of the freezer, as indicated in FIG. 3A.

Main phases for manufacturing the refrigerator 1 according to the invention preferably comprises the following steps:

- providing the outer cabinet 2;
- assembling the inner liner 22 to define the freezer compartment 10 and the fresh food compartment 12;
- assembling the refrigeration system 30 comprising the evaporator 38, wherein the evaporator 38 is arranged inside the freezer compartment 38 at the real wall 24 thereof;
- assembling the fan assembly 50 adjacent to the evaporator 38, wherein the fan assembly 50 is a pre-assembled assembly obtained by fastening together, side by side, the first layer 70, the fan 72, the second layer 74 and the cover plate 76.

Main phases for assembling the fan assembly 50 comprises the following steps:

- mounting the fan 72 to the mounting element 124 (preferably through the damping elements 130);
- connecting the mounting element 124 with the fan 72 to the first layer 70 (preferably through the pins 140);
- assembling the first layer 70 and the second layer 74 therebetween (preferably through insertion of pins 222*a* of the second layer 70 into holes 222*b* of the first layer 70);
- assembling the cover 76 to the first layer 70 (preferably through the fastening device 90).

It is clear that in case the second layer of expanded polystyrene is omitted, according to an alternative preferred embodiment of the invention, the above described assembling steps are simplified since the second layer is obviously not used.

Advantageously, from the above description it has been shown that by providing a pre-assembled fan assembly manufacturing process of refrigeration appliances are simplified compared to known process.

Also, noise and vibrations are reduced compared to known appliances since the fan is firmly sandwiched between the layers of expanded polystyrene.

Reduction of vibrations, then, improve reliability of the refrigerator.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

The invention claimed is:

1. A refrigeration appliance (1) comprising:

an outer cabinet (2) extending in a vertical direction (V) and comprising a base (2A) suitable to lay on the ground, a roof (2B) and lateral side walls (2C, 2D, 2E) connecting said base (2A) and said roof (2B);

an inner liner (22), internal to said outer cabinet (2), defining at least one compartment (10) for receiving food items;

a door (15, 17) apt to open and close said at least one compartment (10);

a refrigeration system (30) comprising an evaporator (38) to cool down air for said at least one compartment (10), said evaporator (38) being arranged inside said at least one compartment (10) at a first wall (24) thereof;

a fan assembly (50) arranged inside said compartment (10) and associated to said evaporator (38) for generating a cooling air stream for said at least one compartment (10);

wherein said fan assembly (50) comprises, arranged side by side:

a first layer (70) of expanded polystyrene arranged side by side with a fan (72), the fan comprising a rotor (82) with a rotation axis (X) inclined with respect to a vertical direction (V); the fan being arranged side by side with a cover plate (76);

wherein said fan assembly (50) comprises a fastening device (90) apt to fasten said cover plate (76) to said first layer (70) to keep said fan assembly (50) in the assembled configuration, and wherein said fan assembly further comprises a second layer of expanded polystyrene arranged between said fan and said cover plate.

2. The appliance (1) according to claim 1, wherein said first layer (70) comprises one or more air conveying channels (100*a*-100*g*) and said cover plate (76) comprises one or more air opening (102*a*-102*g*) communicating with said one or more air conveying channels (100*a*-100*g*) when the fan assembly (50) is assembled.

3. The appliance (1) according to claim 1, wherein said fastening device (90) comprises snap fit elements (92).

4. The appliance (1) according to claim 1, wherein said fastening device (90) comprises elastic tongues (92) protruding from said cover plate (76) interacting with recesses (94) in said first layer (70).

5. The appliance (1) according to claim 1, wherein said first layer (70) comprises a seat (120) to at least partially receive said fan (72).

6. The appliance (1) according to claim 1, wherein said fan assembly (50) comprises a mounting element (124) apt to mount said fan (72) to said first layer (70).

7. The appliance (1) according to claim 6, wherein said mounting element (124) comprises one more pins (140) apt to be inserted in respective one or more through holes (142) of said first layer (70) and comprising blocking elements (146) connected at the tip of said one or more pins and abutting a surface (148) of said first layer (70), allowing the constraint of said mounting element (124) to said first layer (70).

8. The appliance (1) according to claim 6, further comprising vibration dampening elements (130) interposed between said fan (72) and said mounting element (124).

9. The appliance (1) according to claim 1, wherein said fan (72) comprises a frame (80) apt to support said rotor (82).

10. The appliance (1) according to claim 9, wherein said frame (80) is connected to said mounting element (124) through a carrier structure (125).

11. The appliance (1) according to claim 1, wherein said fan assembly (50) further comprises a fan mouth (122) where air flows from said evaporator (38) to said fan (72).

12. The appliance (1) according to claim 11, wherein said fan mouth (122) and said mounting element (124) are integrally made.

13. The appliance (1) according to claim 1, further comprising connecting means (60, 61A, 61B) apt to connect said fan assembly (50) to said first wall (24) of said compartment (10).

14. A method for manufacturing a refrigeration appliance (1) comprising the steps of:

providing an outer cabinet (2);

assembling an inner liner (22) to define a compartment (10) for receiving food items;

assembling a refrigeration system (30) comprising an evaporator (38) wherein said evaporator (38) is arranged inside said compartment (10) at a first wall (24) thereof;

assembling a fan assembly (50) adjacent to said evaporator (38), wherein said fan assembly (50) is a pre-assembled assembly obtained by the steps of fastening together, side by side, the following elements:

a first layer (70) of expanded polystyrene arranged side by side with a fan (72), the fan comprising and a rotor (82) with a rotation axis (X) inclined with respect to a vertical direction (V); the fan being arranged side by side with a cover plate (76);

wherein said fan assembly further comprises a second layer of expanded polystyrene arranged between said fan and said cover plate.

* * * * *